US007938293B2

(12) United States Patent
Gidumal

(10) Patent No.: US 7,938,293 B2
(45) Date of Patent: May 10, 2011

(54) CONTAINER LID

(75) Inventor: Sunil Gidumal, Hong Kong (HK)

(73) Assignee: Planet Canit LLC, Highland Park, IL (US)

( * ) Notice: Subject to any disclaimer, the term of this patent is extended or adjusted under 35 U.S.C. 154(b) by 393 days.

(21) Appl. No.: 11/277,093

(22) Filed: Mar. 21, 2006

(65) Prior Publication Data

US 2007/0221677 A1 Sep. 27, 2007

(51) Int. Cl.
*B65D 43/08* (2006.01)

(52) U.S. Cl. ..... 220/796; 215/224; 220/254.1; 220/619; 220/620

(58) Field of Classification Search ..... 220/254.1, 220/619, 620, 796; 215/224
See application file for complete search history.

(56) References Cited

U.S. PATENT DOCUMENTS

| | | | | |
|---|---|---|---|---|
| 458,361 | A | 8/1891 | Flint | |
| 811,728 | A | 2/1906 | Levin et al. | |
| 1,180,059 | A | 4/1916 | Malawista et al. | |
| 1,204,093 | A | 11/1916 | Wagner | |
| 1,318,999 | A | 10/1919 | Hirshbein | |
| 1,446,458 | A | 2/1923 | Gerhardt | |
| 1,791,417 | A | 2/1931 | Lilienfield | |
| 2,455,767 | A | 12/1948 | Henchert | |
| 3,469,507 | A | 9/1969 | West | |
| 3,543,996 | A | 12/1970 | West | |
| 2006/0261070 | A1 * | 11/2006 | Robertson et al. | 220/276 |

* cited by examiner

*Primary Examiner* — Anthony Stashick
*Assistant Examiner* — Elizabeth Volz
(74) *Attorney, Agent, or Firm* — SNR Denton US LLP

(57) ABSTRACT

A lid construction for a container, canister (can), or the like, includes a top piece and a skirt piece. The top and skirt pieces are connected together using a folded and crimped joint that is located primarily on the inside of the lid adjacent to the inner surface of the skirt and generally below the top surface of the lid, providing a substantially flush and flat upper surface and a substantially flush and flat side surface of the lid at the location of the joint.

19 Claims, 2 Drawing Sheets

CONTAINER LID

BACKGROUND OF THE INVENTION

The present invention generally relates to removable and replaceable lids for containers, such as metal canisters for bakery goods, snacks, candy, nuts, toys, health and beauty items, apparel, coffee, tea, powdered drinks mixes, etc.

Typically, canister lids (such as removable and replaceable lids for metal containers or canisters) have been made from a single piece of metal (blank) that is formed in a press, with the skirt (side wall) of the lid being drawn and stretched, as well as being bent to 90 degrees to the top surface of the lid. While this type of construction is acceptable for many types and sizes of lids, it is not always desirable for lids having a relatively long skirt. When it is desired for the skirt of the lid to be relatively long, for example on the order of 1 or 2 inches, the drawing process limits the ability to include any ornamentation on the lid skirt. If a long-skirted lid is provided with printing on the surface prior to drawing, whether as a solid color, or actual text, the stretching of the metal that occurs in the drawing process causes the color of the ink to change. This change is due to a thinning of the ink as the metal stretches. If too much stretching occurs, then the ink simply falls off of the metal. Furthermore, printing on the lid after it has been drawn into shape is impractical due to the difficulty in printing on the surface of a three-dimensional object as opposed to printing on a flat blank. Thus, long skirted lids have not been able to have printing on them, and other decorative flourishes are required to be put onto the lid after it is formed. Therefore, a need exists for a long skirted lid construction that permits printing on the lid skirt.

As an alternative to drawing lids from a single piece of metal, some lids have been made from crimping two pieces of metal together with one piece typically forming the top of the lid and the other typically forming the lid skirt. Examples of two-piece lid constructions of the prior art are shown and described in U.S. Pat. Nos. 458,361, 811,728, 1,180,059, 1,204,093, 1,318,999, 1,446,458, 1,791,417, 2,455,767, 3,469,507, 3,543,996, the disclosures of which are incorporated herein by reference in their entireties.

Most two-piece lid constructions of the prior art include either a non-flat/non-flush top surface or a non-flat/non-flush sidewall surface, or both, which are often undesirable for several reasons, one example being the aesthetic appearance of the container. The non-flush surface is the result of a crimp connection or lock joint formed to connect the two pieces together. For example, the lid construction disclosed in U.S. Pat. No. 1,791,417, illustrated herein in FIG. 1, includes top piece 110 and side/skirt piece 120. Top piece 110 includes a generally flat central portion, 112, and a perimeter lip, 114. Skirt piece 120 includes a generally flat wall portion, 122, and a top lip, 124, extending outward from the top edge of wall portion 122 and curling downward to form a channel, 126, between the outer surface of wall portion 122 and the inner surface of lip 124. Perimeter lip 114 curls around the outer surface of top lip 124 by extending upward from the outer edge of central portion 112 over the top of top lip 124 and then downward over the outer surface of top lip 124. The outer edge of perimeter lip 114 then extends upward into channel 126. When crimped together, perimeter lip 114 and top lip 124 form a protrusion that extends both up from top piece 110 and outward from side piece 120. A somewhat similar construction is disclosed in U.S. Pat. Nos. 3,469,507 and 3,543,996 and illustrated herein in FIG. 2. As is shown in FIG. 2, skirt piece 220 includes a generally flat wall portion, 222, and a top lip, 224, extending outward from the top edge of wall portion 222 and curling downward to form a channel, 226, between the outer surface of wall portion 222 and the inner surface of lip 224. Top piece 210 includes central portion 212 and perimeter flange 214 extending upward from central portion 212 into channel 222. When crimped together, perimeter flange 214 and top lip 224 form a protrusion that extends both up from top piece 210 and inward from side piece 220. A slightly different lid construction to those described above with respect to FIGS. 1 and 2 is disclosed in U.S. Pat. No. 1,204,093 and illustrated herein in FIG. 3. As is shown in FIG. 3, top piece 310 includes a generally flat central portion, 312, and a perimeter lip, 314, extending downward from the outer edge of central portion 312 and curling inward to form channel 316 between the bottom surface of central portion 312 and the inner surface of lip 314. Skirt piece 320 includes a generally flat wall portion, 322, and a top flange, 324 extending outward from wall portion 322 into channel 316. When crimped together, perimeter lip 314 and top flange 324 form a protrusion that extends outward from sidepiece 320, leaving top piece 310 substantially flat.

The two-piece lid construction disclosed in U.S. Pat. No. 458,361 and illustrated in FIG. 4 provides for a generally flush and flat upper surface, 410 and a generally flush and flat side surface, 420. As is shown in FIG. 4, top piece 410 includes a generally flat central portion, 412, and a perimeter lip, 414, extending downward from the outer edge of central portion 412 and curling inward to form channel 416 between the bottom surface of central portion 412 and the inner surface of lip 414. Skirt piece 420 includes a generally flat wall portion, 422, and a top lip, 424, extending inward from the top edge of wall portion 422 and curling upward and outward to form channel 426. As is discussed in greater detail in U.S. Pat. No. 458,361, channels 416 and 426 are formed simultaneously by bending together the outer perimeter of top piece 410 with the outer edge, 425, of top lip 424. This initially results in the outer perimeter of top piece 410 being non-flush with side piece 420. As is discussed in U.S. Pat. No. 458,361, top piece 410 may then be made flush with side piece 420 by bending side piece 420 downward, forming bend 428. Although this results in a flush and flat upper and outside surface for the lid, the bending process is relatively complex and still results in the bottom surface of the lid having an obtrusive bulge spaced away from the inner surface of side piece 420. A need exists for a lid construction that provides a generally flush transition between the top and skirt portions of the lid, and that also provides an unobtrusive joint between the top and skirt portions of the lid.

SUMMARY OF THE INVENTION

The present invention provides a two piece lid construction for a container, canister (can), or the like, one piece primarily being the top surface of the lid and the other piece primarily being the skirt. The joint connection between the top and skirt of the lid is formed using a folded and crimped joint that is located primarily on the inside of the lid adjacent to the inner surface of the skirt and generally below the top surface of the lid. This construction allows for a substantially flush and flat upper surface and a substantially flush and flat side surface. In addition, this construction provides for a generally unobtrusive joint when viewed from the bottom of the lid as it creates a generally unbroken transition between the skirt, the joint and the top piece.

In one embodiment, the lid of the can is formed differently than the main body of the can, which itself is formed from two separate pieces of metal, one for the sidewall and one for the bottom wall. In this embodiment, the seam between the bottom wall and sidewall of the body is formed with a flange of the sidewall and an outer annular/perimeter portion of the bottom wall being folded over each other and crimped to form a seam that is visible from the exterior of the can and physically protrudes beyond the surface of the can similar to the seam of the prior art lid construction illustrated in FIG. 3. In contrast, the formation of the lid, according to the present invention, while using a folded over and crimped joint, places that joint on the inside of the lid, virtually invisible to the exterior observer (and hardly visible, unobtrusive, when looking inside the lid from the bottom).

In preferred embodiments of the present invention, the top edge of the skirt piece is folded to form a channel for receipt of an outer edge or flange portion of the top surface piece of the lid. In these embodiments a seam or channel is visible, which appears at the top surface of the lid at an abutment of the two pieces of metal, but the vertical extent of the skirt itself is devoid of any joint construction and is fully printable, with color as well as text.

Other details of embodiments of the present invention are illustrated in the drawings and described below.

DETAILED DESCRIPTION OF THE PREFERRED EMBODIMENTS

Figure 5:
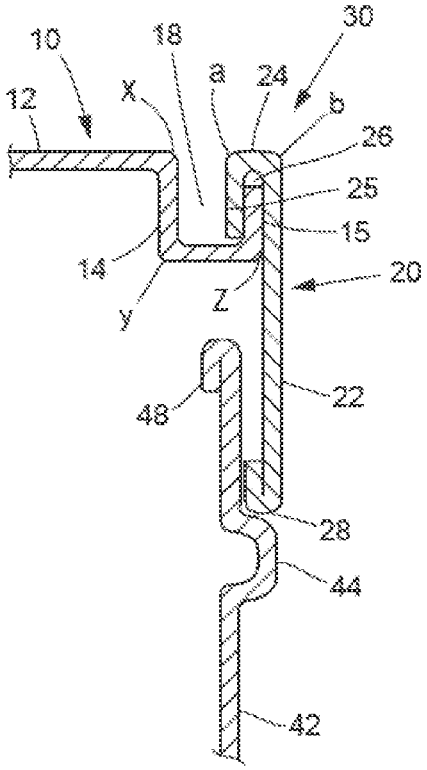
FIG. 5 illustrates a sectional view of a first embodiment of a two-piece lid construction embodying the principles of the present invention.

As illustrated in FIG. 5, a first embodiment of the present invention provides a two-piece lid construction comprising top piece 10 and side/skirt piece 20. Top piece 10 includes a generally flat central portion, 12, and a perimeter flange, 14. Skirt piece 20 includes a generally flat wall portion, 22, and a top lip, 24, extending inward from the top edge of wall portion 22 (at point b of skirt 20) and forming channel 26. Perimeter flange 14 is bent or drawn downward from the outer perimeter of top piece 10 at point x and outward at point y so as to be orientated generally parallel to but below the top surface of central portion 12, then it is bent back upward at point z. In this manner, outer finger 15 of perimeter flange 14 may be located in channel 26, as is shown in FIG. 5, and result in the top surface of central portion 12 being generally flush with the top edge of wall portion 22 between points a and b of skirt 20. The construction of perimeter flange 14 creates channel 18 at (or adjacent to) the abutment of central portion 12 and lip 24. Channel 18 is visible from the top of the lid, as is shown in FIG. 7, and results in an aesthetically pleasing appearance for the top of the lid.

Figure 6:
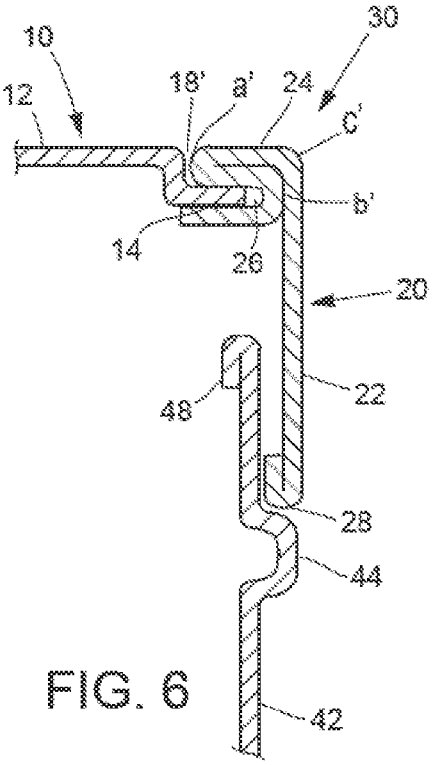
FIG. 6 illustrates a sectional view of a second embodiment of a two-piece lid construction embodying the principles of the present invention

Referring to FIG. 6, an alternative embodiment of the instant invention is shown. As is described with the embodiment shown in FIG. 5, top piece 10 includes a generally flat central portion, 12, and a perimeter flange, 14. In the embodiment shown in FIG. 6, skirt piece 20 includes a generally flat wall portion, 22, and a top lip, 24, extending inward from the top edge of wall portion 22 (at point c' of skirt 20) and forming channel 26. Perimeter flange 14 is bent or drawn downward from the outer perimeter of top piece 10 so as to be orientated generally parallel to but below the top surface of central portion 12. In this manner, perimeter flange 14 may be located in channel 26, as is shown in FIG. 6, and result in the top surface of central portion 12 being flush with the top surface of top lip 24 between the top edge of wall portion 22 (at point c' of skirt 20) and top inner edge of lip 24 (at point a' of skirt 20). The abutment between the outer edge of central portion 12 and top inner edge of lip 24 results in seam 18' which is visible from the top of the lid, as is shown in FIG. 7.

In several embodiments of the present invention, the bottom edge, 28, of wall portion 22 of skirt 20 is folded inward to form a lip. This provides a clean edge at bottom 28 and also provides for a tight frictional seal with the outer surface of sidewall 42 of the canister on which the lid is placed. In other embodiments, the top, 48, of sidewall 42 of the canister is folded inward to form a lip that provides a clean edge at top 48. In still other embodiments, annular stop 44 projects outward from sidewall 42 of the canister to limit the downward movement of the lid as it is placed on the canister. It will be appreciated that alternative configurations of the lid and container connection/seal may be developed without departing from the spirit and scope of the present invention. For example, annular stop 44 may be formed by creating an annular flange at the top of sidewall 42 of the canister similar to the embodiment of perimeter flange 14 discussed above with respect to FIG. 7. In this manner the outer surface of sidewall 22 of lid skirt 20 may be made flush with the lower portion of container sidewall 42 when the lid is positioned on the container.

Figure 1:
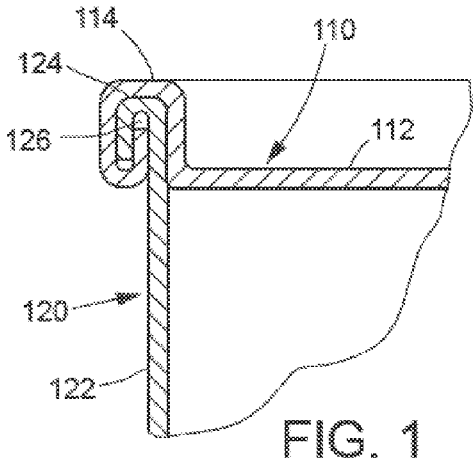
FIG. 1 PRIOR ART
FIG. 1 illustrates a sectional view of the left side of a first two-piece lid construction of the prior art including both a non-flat/non-flush top surface and a non-flat/non-flush sidewall surface.
Figure 2:
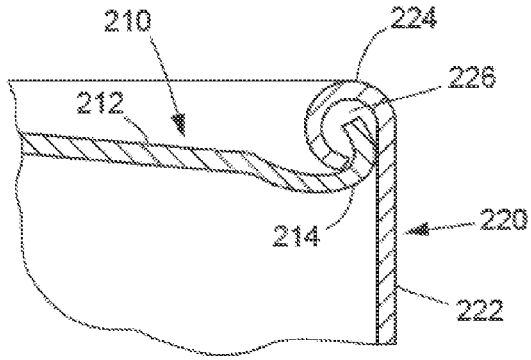
FIG. 2 PRIOR ART
FIG. 2 illustrates a sectional view of the right side of a second two-piece lid construction of the prior art including both a non-flat/non-flush top surface and a non-flat/non-flush sidewall surface.
Figure 3:
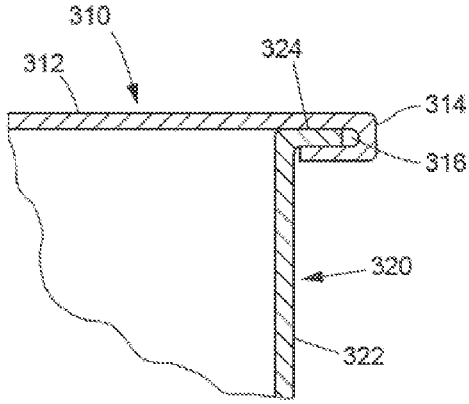
FIG. 3 PRIOR ART
FIG. 3 illustrates a sectional view of a two-piece lid construction of the prior art including a non-flat/non-flush sidewall surface.
Figure 4:
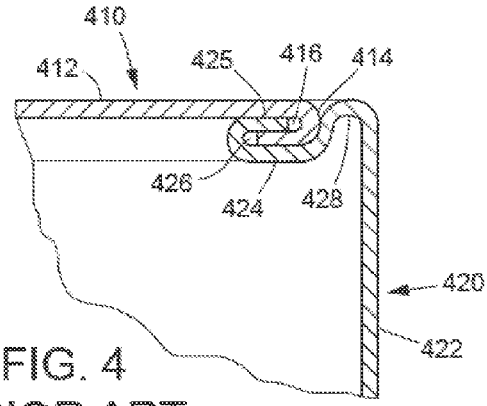
FIG. 4 PRIOR ART
FIG. 4 illustrates a sectional view of a two-piece lid construction of the prior art including a flat/flush top surface and a flat/flush sidewall surface.
Figure 7:
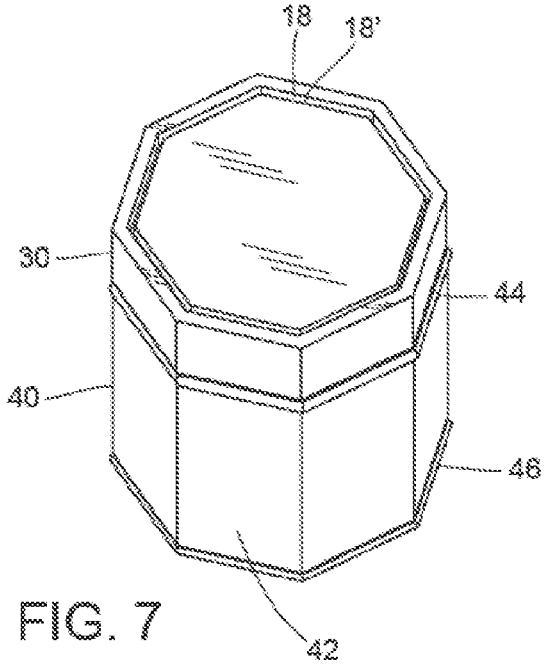
FIG. 7 illustrates a perspective top view of a container utilizing the lid constructions of either FIG. 5 or FIG. 6.

Referring to FIG. 7, an exemplary, octagonal shaped, container utilizing the lid constructions of the present invention (as shown in FIGS. 5 and 6) is shown. Lid 30 is placed on container 40 such that the bottom edge of the skirt of lid 30 abuts annular stop 44, which projects outwardly from container sidewall 42. Lid 30 includes channel 18 or visible seam 18' as are discussed above with respect to FIG. 5 and FIG. 6. The bottom of container 40 includes an outwardly projecting annular flange-seam, 46, that is a crimped joint connection between the bottom wall and sidewall 42 of container 40. The crimped joint connection of seam 46 is formed in a manner similar to that discussed above with respect to the prior art lid construction shown in FIG. 3. It will be appreciated that the actual shape of the lid (and canister) of the present invention may be circular or non-circular, such as the octagonal shape shown in FIG. 7, oval, square, rectangular, etc. Furthermore, it will be appreciated that the shape of the lid of the present invention may take on the shape of any container for which it is desired to be used, whether symmetrical or asymmetrical, simple (i.e. square, rectangle, circle) or complex (i.e. heart-shaped, the shape of a cartoon character's or other person's head, the shape of a state, the shape of a race car, etc.)

Lid 30 of the present invention is formed from two separate pieces (blanks) of material, one blank for top piece 10 and another blank for skirt piece 20. In a preferred embodiment, lid 30 is formed from any of numerous metal materials well known as being suitable for metal containers. In another preferred embodiment, printing is provided on the surface of skirt piece 20 while it is a flat blank. The flat blank for skirt piece 20 is generally rectangular in shape. Lip 24 is formed by folding, bending, or drawing, etc. (referred to herein generically as "bend" or "bending") the top of the blank for skirt piece 20. Referring to the embodiment shown in FIG. 5, lip 24 is formed by bending the top of skirt piece 20 first at point a 90 degrees, and then at point b 90 degrees. Referring to the embodiment shown in FIG. 6, lip 24 is formed by bending the top of skirt piece 20 first at point a' 180 degrees, and folding the blank at point b' 180 degrees in the direction opposite the direction of the bend at point a'. As is shown in FIG. 6, the 180 degree bend at point b' may be accomplished by two separate 90 degree bends to form channel 26 (with the first bend at the top of channel 26 and the second bend at the bottom of channel 26) for receipt of flange 14 of lid top piece 10. Alternatively, the 180 degree bend at point b' may be formed by a single bend that is made in two stages, first the bend is made at point b' such that it is less than 180 degrees (i.e. 135 degrees) to provide a gap for placement of flange 14, once flange 14 is in position, the second stage of the bend is completed to provide the crimp connection with flange 14 located in channel 26. It will be appreciated that such a single two stage bend may also be used in connection with the embodiment of lip 24 shown in FIG. 5.

With respect to the embodiment of lid 30 shown in FIG. 6, after the bends at points a' and b' are completed (note: if a two-stage bend at point b' is utilized, the term "completed" in the context refers to the first stage), a 90 degree downward bend is made at point c' to form skirt sidewall 22. With respect to the embodiment of lid 30 shown in FIG. 5, skirt sidewall 22 is already formed as a result of the bends made at points a and b. If desired, a 180 degree bend is also made at lower edge 28 of skirt sidewall 22 to form the lip discussed above and shown at the bottom of skirt sidewall 22 in FIGS. 5 and 6.

The flat blank for top piece 10 is initially provided or made in the general shape of the container for which it is to be used. Top piece 10 is formed by drawing or bending downward the outer perimeter edge of the flat blank to form flange 14. With respect to the embodiment of lid 30 shown in FIG. 5, the outer perimeter edge of the flat blank is drawn or bent downward 90 degrees at point x, then outward 90 degrees at point y, and then back upward 90 degrees at point z, to form channel 18 within flange 14. Preferably, the length of outer finger 15 of flange 14, which is created by the bend at point z, will have a length equal to the length of outer finger 25 of lip 24, such that the top surface of central portion 12 will be flush with the top of skirt piece 20 between points a and b. With respect to the embodiment of lid 30 shown in FIG. 6, the outer perimeter edge of the flat blank is drawn or bent downward such that flange 14 is offset from central portion 12 of top piece 10. Preferably, flange 14 of the embodiment shown in FIG. 6 is drawn downward a distance that is equal to the thickness of the bent material at point a' of skirt 20 such that the top surface of central portion 12 will be flush with the top of skirt piece 20 between points a' and c'.

Once the above-described bends are completed for both top piece 10 and skirt piece 20, the blank of skirt piece 20 is wrapped around the outside of top piece 10 such that flange 14 is positioned in channel 26. Channel 26 is then crimped about flange 14. With respect to the embodiment shown in FIG. 5, channel 26 is crimped about outer finger 15 of flange 14; in this embodiment, channel 18 provides room for a tool to be inserted to make the crimp. The length of the blank for skirt 20 is such that the two side edges of the rectangular blank will slightly overlap each other once the blank for skirt 20 is wrapped around the blank for top piece 10. This allows the edges to be crimped together in a manner well known in the art. Alternatively, it will be appreciated that other methods of connected the two side edges of the blank for skirt 20, such as welding, may be utilized without departing from the spirit and scope of the instant invention.

It will be appreciated that alternative methods of forming the lid and the crimp configurations between the top and skirt pieces of the lid described herein, as well as alternative lid and crimp configurations entirely, may be utilized without departing from the spirit or scope of the instant invention.

Various components and features are shown and described in different embodiments of the invention, and it should be understood that these various components and features may be used not only in the particular combinations shown and described, but also in other variations of combinations without departing from the spirit of the present invention.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A two piece container lid comprising:

a top piece;

a skirt piece extending generally perpendicular from said top piece; and a joint connection between said skirt piece and said top piece;

wherein, said joint connection includes at least a portion of said skirt piece and at least a portion of said top piece, said at least a portion of said top piece is located in a single plane, said joint connection is generally adjacent to an inner surface of a portion of said skirt piece that is extending generally perpendicular from a portion of said top piece that is not adjacent to said skirt piece, and said portion of the skirt piece included in said joint connection does not extend above the top piece.

2. The container lid as claimed in claim 1 wherein the lid comprises a generally circular shape.

3. The container lid as claimed in claim 1 wherein the lid comprises a generally non-circular shape.

4. The container lid as claimed in claim 3 wherein said non-circular shape is generally symmetrical.

5. The container lid as claimed in claim 4 wherein said generally symmetrical shape is orthogonal.

6. The container lid as claimed in claim 1 wherein said joint connection further comprises a channel formed from said skirt piece adapted to receive an outer edge of said top piece.

7. The container lid as claimed in claim 6 wherein said outer edge of said top piece includes a flange offset from the remainder of said top piece.

8. The container lid as claimed in claim 7 wherein said flange offset is formed by a series of bends in said outer edge of said top piece.

9. The container lid as claimed in claim 8 wherein said series of bends includes at least first, second and third bends.

10. A two-piece container lid comprising:

a top piece;

a skirt piece extending generally perpendicular from said top piece; and a crimp joint connection between said skirt piece and said top piece;

wherein, said joint connection provides a generally flush transition between an outer surface of said top piece and an outer surface of said skirt piece, and a generally unbroken transition between an inner surface of said top piece and an inner surface of said skirt piece, such that said skirt piece does not extend above the top piece said joint connection is touching an inner surface of a portion of said skirt piece that is extending generally perpendicular from a portion of said top piece that is not touching said skirt piece, and at least a portion of said top piece is located in a single plane.

11. The container lid as claimed in claim 10 wherein the lid comprises a generally circular shape.

12. The container lid as claimed in claim 10 wherein the lid comprises a generally non-circular shape.

13. The container lid as claimed in claim 12 wherein said non-circular shape is generally symmetrical.

14. The container lid as claimed in claim 13 wherein said generally symmetrical shape is orthogonal.

15. The container lid as claimed in claim 10 wherein said joint connection includes at least a portion of said skirt piece and at least a portion of said top piece.

16. The container lid as claimed in claim 15 wherein said joint connection further comprises a channel formed from said skirt piece adapted to receive an outer edge of said top piece.

17. The container lid as claimed in claim 16 wherein said outer edge of said top piece includes a flange offset from the remainder of said top piece.

18. The container lid as claimed in claim 17 wherein said flange offset is formed by a series of bends in said outer edge of said top piece.

19. The container lid as claimed in claim 18 wherein said series of bends includes at least first, second and third bends.

* * * * *